US005848335A

United States Patent [19]

Folkins et al.

[11] Patent Number: 5,848,335

[45] Date of Patent: Dec. 8, 1998

[54] INTERNAL ERASE BEFORE LAST DEVELOPMENT IN COLOR ELECTROPHOTOGRAPHIC PRINTING

[75] Inventors: Jeffrey J. Folkins; Charles H. Tabb, both of Rochester, N.Y.

[73] Assignee: Xerox Corporation, Stamford, Conn.

[21] Appl. No.: 892,864

[22] Filed: Jul. 14, 1997

[51] Int. Cl.[6] ..... G03G 15/01

[52] U.S. Cl. ..... 399/186; 399/39; 399/40; 399/231

[58] Field of Search ..... 399/186, 39, 40, 399/231, 232, 223, 228, 298; 347/55

[56] References Cited

U.S. PATENT DOCUMENTS 4,959,695 9/1990 Nishimura et al. ..... 399/232

*Primary Examiner*—Arthur T. Grimley
*Assistant Examiner*—Quana Grainger
*Attorney, Agent, or Firm*—John M. Kelly

[57] ABSTRACT

A multistation color electrophotographic printer having an erase lamp located opposed to or before the last physical developer housing, but after the first physical developer housing.

3 Claims, 1 Drawing Sheet

INTERNAL ERASE BEFORE LAST DEVELOPMENT IN COLOR ELECTROPHOTOGRAPHIC PRINTING

FIELD OF THE INVENTION

This invention relates to electrophotographic color printer architectures.

BACKGROUND OF THE INVENTION

Electrophotographic marking is a well known and commonly used method of copying or printing documents. Electrophotographic marking is performed by exposing a light image representation of a desired document onto a substantially uniformly charged photoreceptor. In response to that image the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a prototypical black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. The charge, expose, and develop process is repeated for a second color, say yellow, then for a third color, say magenta, and finally for a fourth color, say cyan. The various color toner particles are placed in superimposed registration such that a desired composite color image results. That composite color image is then transferred and fused onto a substrate.

The REaD IOI process can be implemented using a number of different architectures. For example, in a single pass printer wherein a composite final image is produced in one pass of the photoreceptor through the machine. A second architecture is a four pass printer, wherein only one color toner image is produced during each pass of the photoreceptor through the machine and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass through the machine.

The single pass architecture is very fast, but expensive since four charging stations and four exposure stations are required. The four pass architecture is slower, since four passes of the photoreceptive surface are required, but also much cheaper since it only requires a single charging station and a single exposure station. Five cycle printing is even slower since five passes of the photoreceptive surface are required, but has the advantage that multiple uses can be made of various stations (such as using a charging station for transfer). Furthermore, five cycle printing also has the advantage of a smaller footprint. Finally, five cycle printing has a decided advantage in that no color image is produced in the same cycle as transfer, fusing, and cleaning when mechanical loads are placed on the drive system.

Regardless of which architecture is used, space around the photoreceptor is usually at a premium. A charging system, exposure system, multiple developers, a transfer station, and a cleaning station all must be located adjacent the photoreceptor. Furthermore, as small size is a desirable feature of desktop color printers, minimizing the size of the photoreceptor is important. Indeed, in some machine designs there is insufficient space to physically locate all of the desired system components when using prior art system arrangement schemes. For example, to improve the transfer of the composite color image onto a substrate it is often desirable to include an erase lamp to neutralize the charges on the photoreceptor after final development but before transfer. However, in the prior art that erase lamp would take up space that is not available or would be disadvantageous to provide for. Therefore, a new multicolor electrophotographic printer system arrangement scheme would be beneficial.

SUMMARY OF THE INVENTION

This invention provides for a multicolor electrophotographic printer system arrangement scheme in which an erase lamp is located opposed to or before the last physical developer housing, but after the first physical developer housing.

BRIEF DESCRIPTION OF THE DRAWINGS

Other aspects of the present invention will become apparent as the following description proceeds and upon reference to FIG. 1, which schematically illustrates a four cycle electrophotographic printing machine that incorporates the principles of the present invention.

DETAILED DESCRIPTION OF A PREFERRED EMBODIMENT OF THE INVENTION

Figure 1:
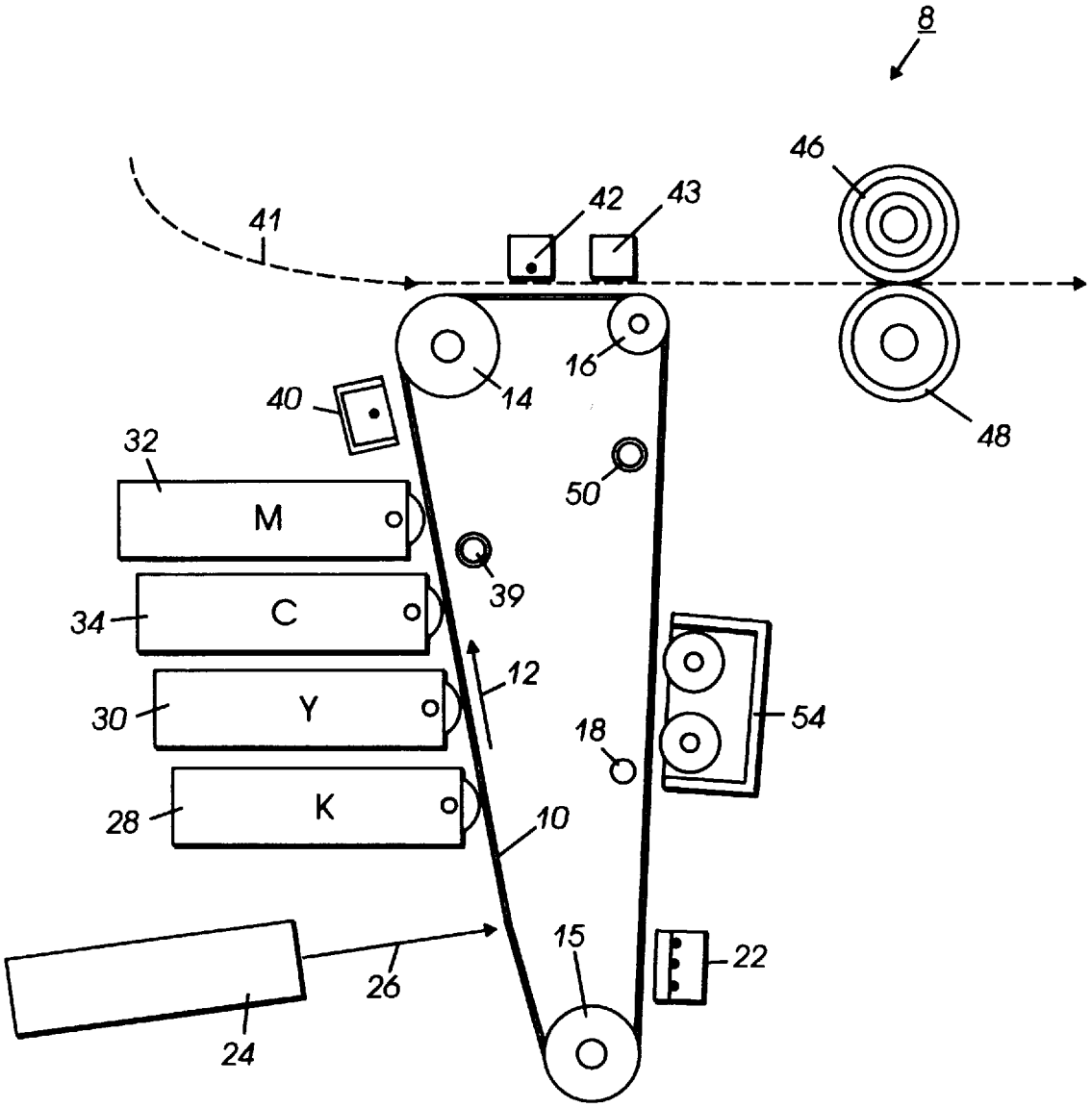

Referring now to FIG. 1, a preferred embodiment of the present invention is a four cycle electrophotographic printing machine 8 which incorporates an erase lamp between a third developing station and a fourth developing station. While the preferred embodiment uses individual subsystems which are known in the prior art, they are organized and used in a new, useful, and nonobvious manner.

The printing machine 8 includes an Active Matrix (AMAT) photoreceptor belt 10 which travels in the direction indicated by the arrow 12. Belt travel is brought about by mounting the photoreceptor belt about a drive roller 14 (that is driven by a motor which is not shown) and tension rollers 15 and 16.

As the photoreceptor belt travels each part of it passes through each of the subsequently described process stations. For convenience, a single section of the photoreceptor belt, referred to as the image area, is identified. The image area is that part of the photoreceptor belt which is to receive the various toner layers which, after being transferred and fused to a substrate, produce the final color image. While the photoreceptor belt may have numerous image areas, since each image area is processed in the same way, a description of the processing of one image area suffices to fully explain the operation of the printing machine.

As mentioned, the production of a color document takes place in 4 cycles. The first cycle begins with the image area passing a "precharge" erase lamp 18 that illuminates the image area so as to cause any residual charge which might exist on the image area to be discharged. Such erase lamps are common in high quality systems and their use for initial erasure is well known.

The image area, processing stations, belt travel, and cycles define two relative directions, upstream and downstream. A given processing station is downstream of a second processing station if, in a given cycle, the imaging area passes the given processing station after it passes the second processing station. Conversely, a given processing station is upstream of a second if, in a given cycle, the imaging area passes the given processing station before it passes the second processing station.

As the photoreceptor belt continues its travel the image area passes through a charging station comprised of an AC scorotron 22. To charge the image area in preparation for exposure to create a latent image for black toner the AC scorotron charges the image area to a substantially uniform potential of, for example, about −500 volts. It should be understood that the actual charge placed on the photoreceptor for the black toner (and the other toner layers that are subsequently described) will depend upon many variables, such as toner mass and the settings of a subsequent development station (see below).

After passing the charging station the image area advances until it reaches an exposure station 24. At the exposure station the charged image area is exposed to a modulated laser beam 26 that raster scans the image area such that an electrostatic latent representation of a black image is produced. For example, illuminated sections of the image area might be discharged by the beam 26 to about −50 volts. Thus after exposure the image area has a voltage profile comprised of relatively high voltage areas of about −500 volts and of relatively low voltage areas of about −50 volts.

After passing the exposure station 24 the exposed image area passes a black development station 28 which deposits negatively charged black toner particles onto the image area. The charged black toner adheres to the illuminated areas of the image area thereby causing the voltage of the illuminated parts of the image area to be about −200 volts. The non-illuminated parts of the image area remain at −500 volts.

After passing the black development station the image area advances past a number of other stations, whose purposes are described subsequently, and returns to the precharge erase lamp 18. The second cycle then begins.

If either AC re-charging or split re-charging were directly used to recharge the image areas in the second cycle, significant amounts of black toner particles might be pulled off of the photoreceptor and deposited into the yellow developer, thereby causing Black in Yellow contamination. However, it has been found that a successful AC only recharge can be performed if the photoreceptor is first exposed so as to reduce the charges on the image area prior to recharging. In the electrophotographic printing machine 8 this is performed using the precharge erase lamp 18 to expose the image area. Therefore, as the image area advances past the precharge erase lamp 18, that lamp illuminates the image area.

After passing the precharge erase lamp the AC scorotron 22 recharges the image area to the charge level desired for exposure and development of the yellow image. Beneficially the AC scorotron has a high slope: a small voltage variation on the image area results in large charging currents. The voltage applied to the metallic grid of the AC scorotron 22 can be used to control the voltage at which charging currents are supplied to the image area.

The recharged image area with its black toner layer then advances to the exposure station 24. The exposure station exposes the image area with the beam 26 so as to produce an electrostatic latent representation of a yellow image. As an example of the charges on the image area, the non-illuminated parts of the image area might have a potential about −450 while the illuminated areas are discharged to about −50 volts.

After passing the exposure station 24 the now exposed image area advances past a yellow development station 30 that deposits yellow toner onto the image area. Since the image area already has a black toner layer the yellow development station should use a scavengeless developer.

After passing the yellow development station the image area and its two toner layers advance past the precharge erase exposure lamp, which is once again illuminated so as to discharge the image area. This is the start of the third cycle. The AC scorotron 22 recharges the image area and its two toner layers in preparation for the third exposure station. The exposure station 24 again exposes the image area to the beam 26, this time with a light representation that discharges some parts of the image area to create a electrostatic latent representation of a magenta image. The image area then advances through a magenta development station 32.

As shown in FIG. 1, the magenta development station 32 is physically the last development station: that is, it is physically located downstream of all of the other development stations, in particular the cyan development station 34. The magenta development station, preferably a scavengeless developer, advances magenta toner onto the image area. The result is a third toner layer on the image area.

The image area with its three toner layers then advances past the illuminated precharge erase lamp. The fourth cycle begins. The AC scorotron 22 again recharges the image area (which now has three toner layers) to produce the desired charge on the photoreceptor. The substantially uniformly charged image area with its three toner layers then advances once again to the exposure station 24. The exposure station exposes the image area again, this time with a light representation that discharges some parts of the image area to create an electrostatic latent representation of a cyan image. After passing the exposure station the image area passes the cyan development station 34. The cyan development station, also a scavengeless developer, advances cyan toner onto the image area.

While the cyan development station is the last of the four development stations used to produce a toner layer, it is physically located upstream of the magenta development station 32.

After passing the cyan development station the image area has four toner layers which together make up a composite color toner image. That composite color toner image is comprised of individual toner particles which have charge potentials which vary widely. Indeed, some of those particles take a positive charge. Transferring such a composite toner image onto a substrate would result in a degraded final image. Therefore it is beneficial to prepare the composite color toner image for transfer.

Preparation for transfer is partially performed by illuminating the image area using a pre-transfer erase lamp 39 so as to discharge most of the residual charges on the image and non-image photoreceptor areas. As shown in FIG. 1, the pretransfer erase lamp is located upstream of the magenta development station 32, but downstream of the cyan development station 34. Additionally, the erase lamp is located adjacent the inside surface of the photoreceptor belt 10.

Locating the pre-transfer erase lamp in this position allows for a particularly compact design since a space around the photoreceptor that is downstream of all of the development stations but upstream of the transfer station (described subsequently) need not be used. Additionally, there are times when there is a requirement that to maintain photoreceptor charge stability and consistency that there should be allowed a minimum time delay between the erase lamp 39 discharge and the charger 40. Hence even if there were adequate space to place the lamp 39 subsequent to the last developer housing it would still advantageous to position the lamp 39 before the last developer housing After passing the pretransfer erase lamp 39 the image area is substantially discharged, but not entirely. Indeed, the toner layers on the image area include both positive and negative charges. To further prepare the toner layers for transfer it is beneficial to ensure that only one polarity of charge exists on the toner particles. This is performed by passing the image area past a scorotron 40 that supplies sufficient ions to the image area that substantially all of the previously positively charged toner particles are reversed in polarity.

The image area then continues to advance in the direction 12, past the drive roller 14. A substrate 41 is then placed over the image area using a sheet feeder (which is not shown). As the image area and substrate continue their travel they pass a transfer corotron 42. That corotron applies positive ions onto the back of the substrate 41. Those ions attract the negatively charged toner particles onto the substrate.

As the substrate continues its travel it passes a detack corotron 43. That corotron neutralizes some of the charge on the substrate to assist separation of the substrate from the photoreceptor 10. As the lip of the substrate moves around the tension roller 16 the lip separates from the photoreceptor. The substrate 41 is directed into a fuser where a heated fuser roller 46 and a pressure roller 48 create a nip through which the substrate passes. The combination of pressure and heat at the nip causes the composite color toner image to fuse into the substrate. After fusing, a chute, not shown, guides the support sheets to a catch tray, also not shown, for removal by an operator.

After the substrate is separated from the photoreceptor belt 10 the image area continues its travel and passes a preclean erase lamp 50. That lamp neutralizes most of the charge remaining on the photoreceptor belt and on any residual toner or debris that may be on the photoreceptor. After passing the preclean erase lamp the residual toner and/or debris on the photoreceptor is removed at a cleaning station 52. At the cleaning station two cleaning brushes wipe residual toner particles from the image area. This marks the end of the 4th cycle. The image area then passes once again to the precharge erase lamp and the start of another 4 cycles.

Using well known technology the various machine functions described above are generally managed and regulated by a controller which provides electrical command signals for controlling the operations described above.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A color printing machine, comprising:

a photoreceptor having a first surface and a second surface that move in a predetermined direction;

an exposure station for exposing said photoreceptor so as to produce a first latent image, a second latent image, a third latent image, and a fourth latent image, wherein said latent images together represent a composite image;

a first development station for depositing a charged first toner layer on said first latent image, said first development station being adjacent said first surface and located downstream of said exposure station;

a second development station for depositing a charged second toner layer on said second latent image, said second development station being adjacent said first surface and located downstream of said first development station;

a third development station for depositing a charged third toner layer on said third latent image, said third development station being adjacent said first surface and located downstream of said second development station;

a fourth development station for depositing a charged fourth toner layer on said fourth latent image, said fourth development station being adjacent said first surface and located downstream of said third development station;

a transfer station adjacent said photoreceptor and located downstream of said fourth development station; and an erase lamp adjacent said second surface;

wherein said erase lamp is located downstream of said first development station and upstream of said fourth development station;

wherein a downstream development station develops its toner layer before an upstream development station develops its toner layer; and wherein said erase lamp erases charges on said first toner layer, on said second toner layer, on said third toner layer, and on said fourth toner layer.

2. A color printing machine according to claim 1, wherein said charged first toner layer is black.

3. A color printing machine according to claim 2, wherein said charged second toner layer is yellow.

* * * * *